US007034215B2

(12) United States Patent
Kaneko et al.

(10) Patent No.: US 7,034,215 B2
(45) Date of Patent: Apr. 25, 2006

(54) PERFORMANCE APPARATUS

(75) Inventors: Yasutoshi Kaneko, Hamamatsu (JP); Shigeru Muramatsu, Mori-machi (JP)

(73) Assignee: Yamaha Corporation, (JP)

( * ) Notice: Subject to any disclaimer, the term of this patent is extended or adjusted under 35 U.S.C. 154(b) by 312 days.

(21) Appl. No.: 10/454,692

(22) Filed: Jun. 5, 2003

(65) Prior Publication Data

US 2003/0230188 A1 Dec. 18, 2003

(30) Foreign Application Priority Data

Jun. 7, 2002 (JP) ..... 2002-166856

(51) Int. Cl.
*G10F 1/06* (2006.01)

(52) U.S. Cl. ..... 84/98; 84/408

(58) Field of Classification Search ..... 84/19–23, 84/94.1–99, 408, 405, 409
See application file for complete search history.

(56) References Cited

U.S. PATENT DOCUMENTS 5,276,270 A * 1/1994 Kondo ..... 84/22
5,530,198 A * 6/1996 Ishii ..... 84/21
6,559,369 B1 * 5/2003 Gilmore ..... 84/455

* cited by examiner

*Primary Examiner*—Marlon T. Fletcher
*Assistant Examiner*—David S. Warren
(74) *Attorney, Agent, or Firm*—Dickstein, Shapiro, Morin & Oshinsky, LLP.

(57) ABSTRACT

There is provided a performance apparatus that can reduce energy consumption while allowing sounding elements to appropriately generate sound. A CPU supplies driving energy to an actuator to drivingly control the same based on pulse width modulation. A rotary pick is rotatively driven by the actuator to pluck reeds to generate sound. The CPU sets the duty of a driving pulse for driving the rotary pick during time points t3 and t4. Thus, higher driving energy is supplied to the actuator in timing in which the rotary pick plucks any of the reeds than in timing in which the rotary pick does not pluck any of the reeds.

11 Claims, 9 Drawing Sheets

PERFORMANCE APPARATUS

BACKGROUND OF THE INVENTION

1. Field of the Invention

The present invention relates to a performance apparatus that applies driving energy such as electricity to a sounding element acting member to cause sounding elements such as reeds to generate sound.

2. Description of the Related Art

A performance apparatus such as a music box type has hitherto been known which causes sounding elements such as reeds to generate sound by means of a driving device such as a solenoid coil, that acts upon or plucks the sounding elements, without using a barrel drum.

For example, a performance apparatus of this type has been proposed by the assignee of the present application (Japanese Patent Application No. 2002-079132). This performance apparatus is comprised of a rotating member acting as a sounding element acting member and provided with a plurality of driving nails in its outer periphery, and a swing arm with a flat coil, acting as an actuator. The flat coil is disposed to be located in a magnetic field that is generated. When the flat coil is energized, the swing arm is rotated. When a free end of the swing arm drives part of the driving nails of the rotating member to thus rotate the rotating member, which causes the other driving nails to pluck reeds to generate sound.

Further, another performance apparatus of this type has been proposed by the assignee of the present application, according to which part of driving nails of a rotating member as a sounding element acting member is engaged in and driven by a groove formed in a plunger acting as an actuator, which is driven to make reciprocating motions by a solenoid coil, to thereby pluck reeds in the same manner as in the first-mentioned performance apparatus. Alternatively, the solenoid coil may be used to reciprocate the plunger without using the rotating member, thus causing a driving part fixedly provided on the plunger to directly pluck the reeds.

However, the above proposed performance apparatuses have problems described below. That is, with these apparatuses, the maximum power is required when the reeds are plucked, i.e. when the sounding elements are acted upon. However, sufficient driving energy is uniformly applied over a wide range of the operating stroke of the actuator such as the swing arm or the plunger. Consequently, high power is consumed even in a range of the operating stroke in which large energy is not needed, and energy is thus wasted.

Another problem with the proposed performance apparatuses is that more driving energy than required is applied to the sounding element acting member such as the rotating member and the actuator so that the sounding element acting member and the actuator strongly engage or urgingly contact each other, to generate a loud mechanical noise.

Further, if it is configured such that a reciprocating member such as the plunger comes into contact with a stopper to define the end of the operating stroke of the reciprocating member, then a mechanical noise which is not negligible is generated due to the urging contact between the reciprocating member and the stopper.

SUMMARY OF THE INVENTION

It is a first object of the present invention to provide a performance apparatus that can reduce energy consumption while allowing sounding elements to properly generate sound.

It is a second object of the present invention to provide a performance apparatus that can suppress mechanical noise.

To attain the first object, in a first aspect of the present invention, there is provided a performance apparatus comprising a plurality of sounding elements, at least one sounding element acting member that can act upon the sounding elements to cause the sounding elements to generate sound, at least one actuator that drives the sounding element acting member, and a driving control device that drivingly controls the actuator by supplying driving energy to the actuator, wherein the driving control device drivingly controls the actuator such that higher driving energy is supplied to the actuator in timing in which the sounding element acting member acts upon any of the sounding elements than in timing in which the sounding element acting member does not act upon any of the sounding elements.

According to this arrangement, higher driving energy is supplied to the actuator in a timing in which the sounding element acting member acts upon any of the sounding elements and when the maximum power is required than in a timing in which the sounding element acting member does not act upon any of the sounding elements. Consequently, at the time of the operation, a sound is properly produced with the maximum power, and during the other time periods, the driving energy is saved. Thus, energy consumption can be reduced while allowing the sounding elements to properly generate sound.

Preferably, the performance apparatus according to the present invention further comprises an action state detecting device that detects a state of action that is exerted by the sounding element acting member upon the sounding elements, and wherein the driving control device is operable based on the state of action detected by the action state detecting device, for drivingly controlling the actuator such that the driving energy supplied to the actuator is changed in at least one of timing in which the sounding element acting member acts upon any of the sounding elements and timing immediately before the sounding element acting member acts upon any of the sounding elements.

Preferably, the performance apparatus according to the present invention further comprises an action state detecting device that detects a state of action that is exerted by the sounding element acting member upon the sounding elements, and wherein the driving control device is operable based on the state of action detected by the action state detecting device, for drivingly controlling the actuator so as to correct timing in which the driving energy is supplied to the actuator and which corresponds to the timing in which the sounding element acting member acts upon any of the sounding elements.

Preferably, the driving control device drivingly controls the actuator by changing the driving energy using pulse modulation.

Preferably, the performance apparatus according to the present invention performance apparatus further comprises a storage device that stores a predetermined table for determining magnitude of the driving energy, and wherein the driving control device drivingly controls the actuator by referring to the predetermined table stored in the storage device.

More preferably, the performance apparatus according to the present invention further comprises an action state detecting device that detects a state of action that is exerted by the sounding element acting member upon the sounding elements, and an updating device that updates contents of the predetermined table stored in the storage device based on the state of action detected by the action state detecting device.

To attain the second object, in a second aspect of the present invention, there is provided a performance apparatus comprising a plurality of sounding elements, at least one sounding element acting member that can act upon the sounding elements to cause the sounding elements to generate sound, at least one actuator that is engageable with the sounding element acting member, for driving the sounding element acting member, and a driving control device that drivingly controls the actuator by supplying driving energy to the actuator, wherein the driving control device drivingly controls the actuator such that lower driving energy is supplied to the actuator in timing immediately before the actuator engages with the sounding element acting member than in timing in which the sounding element acting member acts upon any of the sounding elements.

According to this arrangement, lower driving energy is applied to the actuator in a timing immediately before the engagement between the actuator and the sounding element acting member, which engagement is likely to generate a mechanical noise, than in a timing in which the sounding element acting member acts upon the sounding elements. Consequently, at the time of the operation, high power is provided to quickly operate the actuator to properly generate sound. When the actuator and the sounding element acting member engage with each other, the actuator operates more slowly to weaken a shock upon the engagement. Therefore, mechanical noise can be reduced while allowing the sounding elements to properly generate sound.

Preferably, the driving control device drivingly controls the actuator by changing the driving energy using pulse modulation.

Preferably, the performance apparatus according to the present invention further comprises a storage device that stores a predetermined table for determining magnitude of the driving energy, and wherein the driving control device drivingly controls the actuator by referring to the predetermined table stored in the storage device.

More preferably, the performance apparatus according to the present invention further comprises an action state detecting device that detects a state of action that is exerted by the sounding element acting member upon the sounding elements, and an updating device that updates contents of the predetermined table stored in the storage device based on the state of action detected by the action state detecting device.

To attain the second object, in a third aspect of the present invention, there is provided a performance apparatus comprising a plurality of sounding elements, at least one sounding operating device having at least one sounding element acting member and at least one reciprocating member, wherein the sounding element acting member acts upon any of the sounding elements in unison with a reciprocating motion of the reciprocating member to cause the sounding element to generate sound, a driving control device that drivingly controls the reciprocating member in a forward direction by supplying driving energy to the sounding operating device, a returning device that urges the reciprocating member in a backward direction, for returning the reciprocating member into an original position thereof, and a stopper that is disposed for contact with the reciprocating member, for defining a backward stroke end position of the reciprocating member, wherein the driving control device drivingly controls the reciprocating member such the driving energy for urging the reciprocating member in the forward direction is supplied to the sounding operating device in timing immediately before the reciprocating member and the stopper come in contact with each other, to suppress the reciprocating member from returning into the original position thereof.

According to this arrangement, driving energy that biases the sounding operation device in the forward direction to suppress its return operation, in a timing immediately before the sounding operation device and the stopper come into contact with each other, which contact is likely to generate a mechanical noise. Consequently, immediately before the sounding operation device and the stopper come into contact with each other, the sounding operation device performs a slower return operation to weaken a shock upon the contact. Therefore, mechanical noise can be reduced.

The above and other objects, features, and advantages of the invention will become more apparent from the following detailed description taken in conjunction with the accompanying drawings.

BRIEF DESCRIPTION OF THE DRAWINGS

FIGS. 5A to 5I are views showing successive changes in motion of essential parts of the actuator, in which:

FIG. 5A is a view showing initial positions of essential parts of the actuator;

FIGS. 5B to 5H are views showing a plunger and a hook part during their reciprocating motions; and FIG. 5I is a view showing a state in which the plunger and the hook part have returned to their initial positions;

FIGS. 7A and 7B collectively form a timing chart, in which:

FIG. 7A shows a PWM control waveform; and

FIG. 7B shows a stroke position of the plunger;

DETAILED DESCRIPTION OF THE PREFERRED EMBODIMENTS

The present invention will now be described below with reference to the accompanying drawings showing preferred embodiments thereof.

Figure 1:
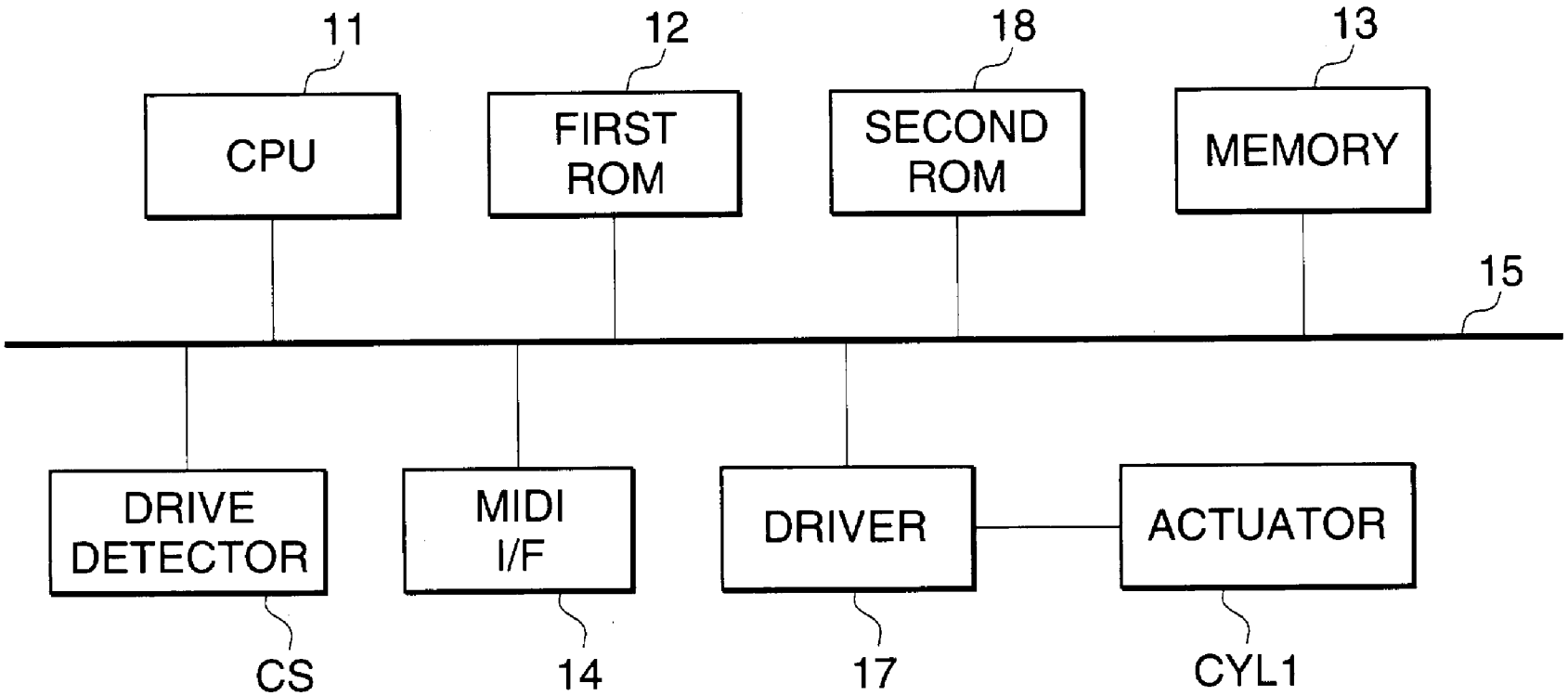
FIG. 1 is a block diagram showing the construction of a control section of a performance apparatus according to a first embodiment of the present invention.

FIG. 1 is a block diagram showing the construction of a control section of a performance apparatus according to a first embodiment of the present invention.

The performance apparatus according to the present embodiment is comprised of a first ROM 12, a memory 13 (storage device), a MIDI interface (MIDI I/F) 14, a second ROM 18, and drive detectors CS (operative state detecting device), a driver 17, and a CPU 11 to which the above component parts are connected via a bus 15. The CPU 11 controls the entire apparatus. The first ROM 12 is comprised of a program ROM, a data ROM, and a working ROM, none of which are shown, and stores control programs to be executed by the CPU 11, various data, and so on. The MIDI I/F 14 receives performance data input from a MIDI instrument, not shown, or the like, as MIDI (Musical Instrument Digital Interface) signals. The memory 13 is comprised of a RAM or the like, and stores various data including performance data and can store performance data input from the MIDI I/F 14. The second ROM 18 stores parameter tables and the like. The driver 17 drivingly controls actuators CYL1, described hereinafter.

Figure 2:
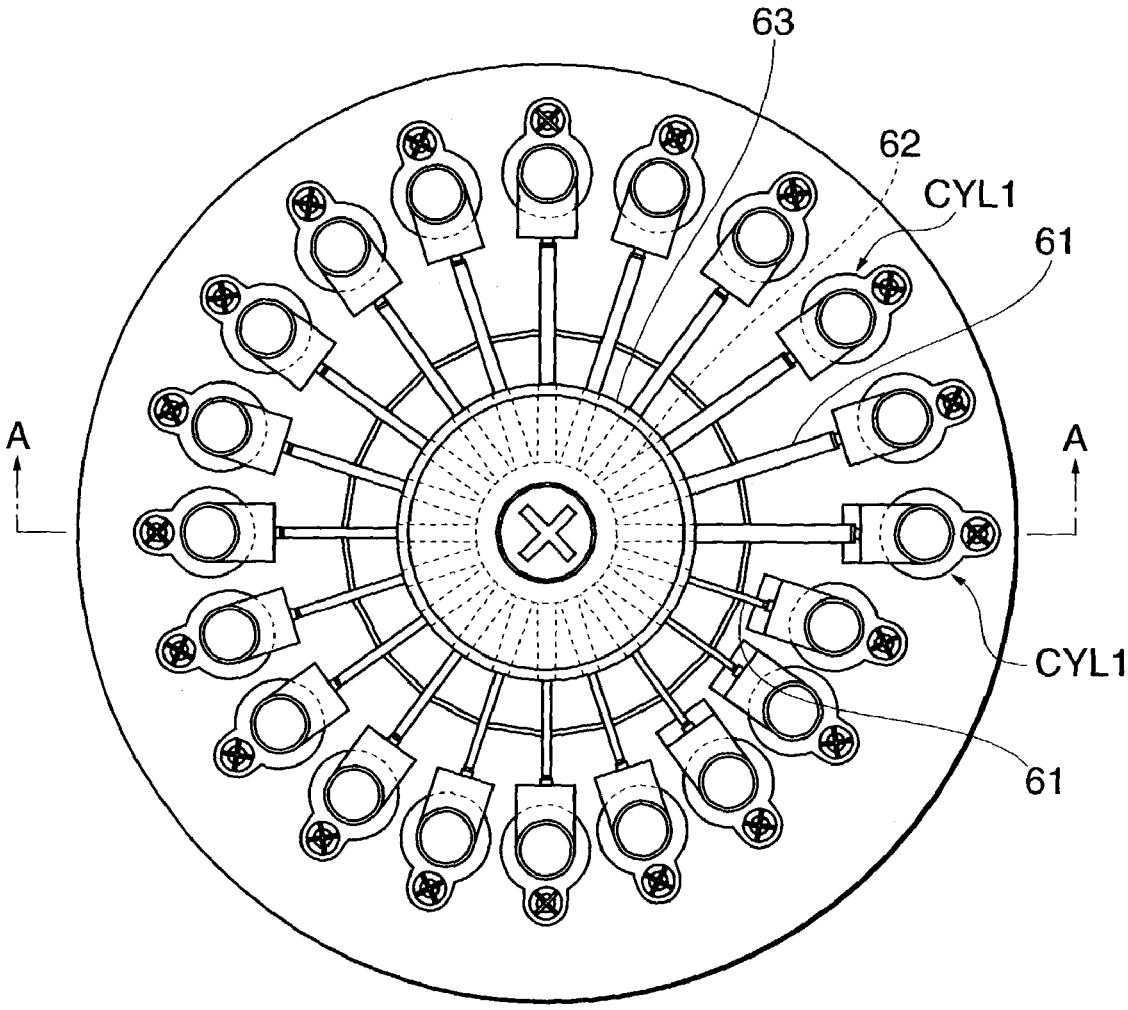
FIG. 2 is a top plan view of the performance apparatus according to the first embodiment.
Figure 3:
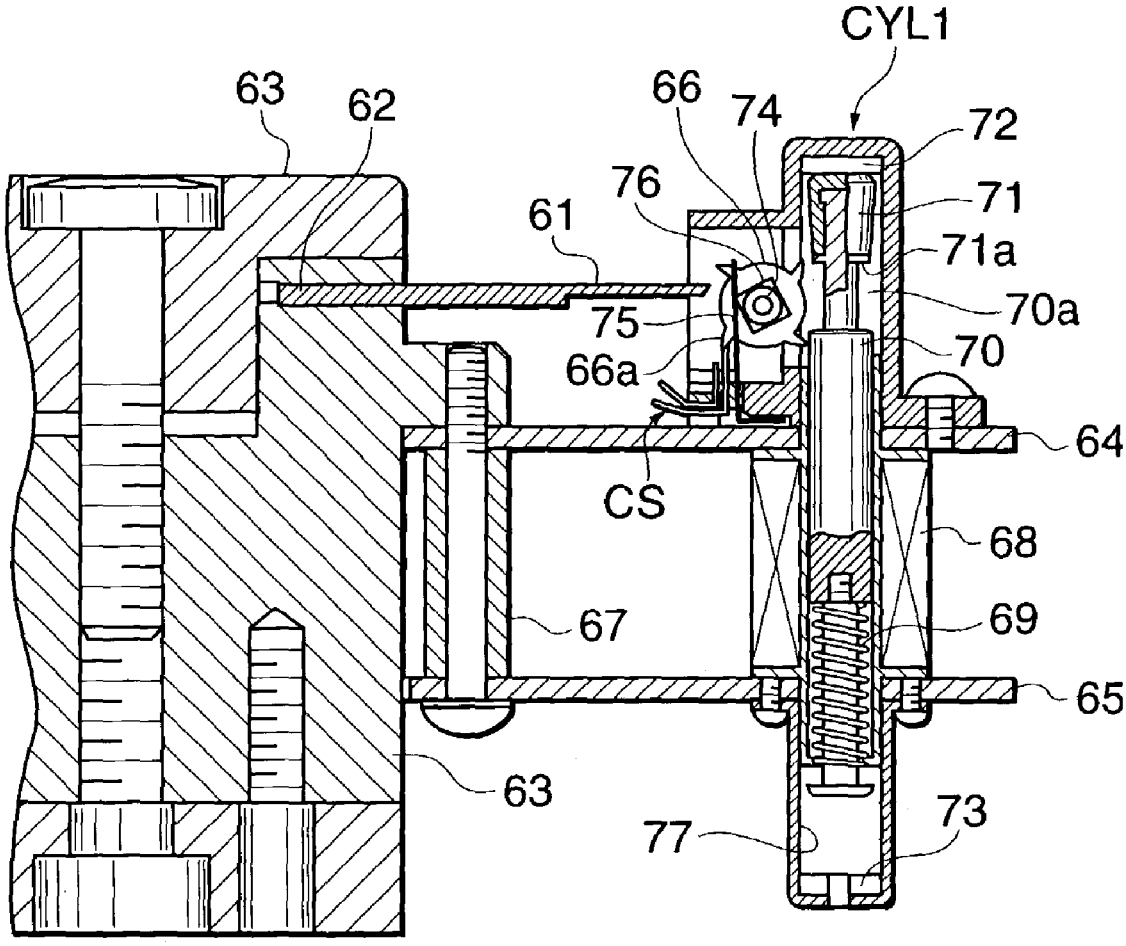
FIG. 3 is a sectional view taken along line A—A in FIG. 2.
Figure 4A:
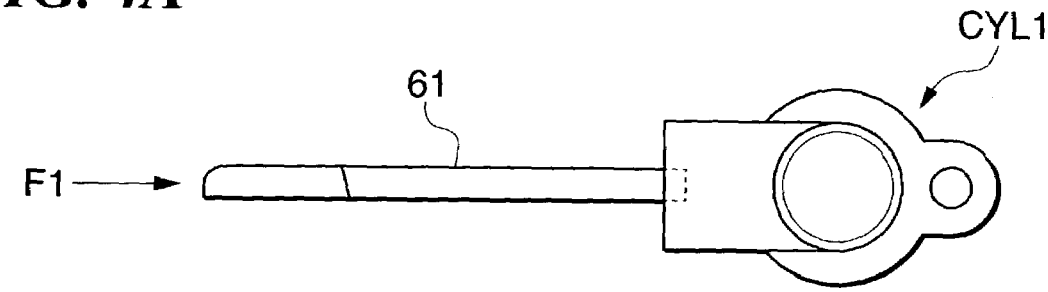
FIG. 4A is a top plan view of an actuator.
Figure 4B:
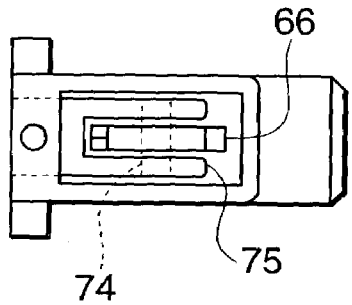
FIG. 4B is a view of the actuator in FIG. 4A as viewed from an arrow F1 in FIG. 4A.
Figure 4C:
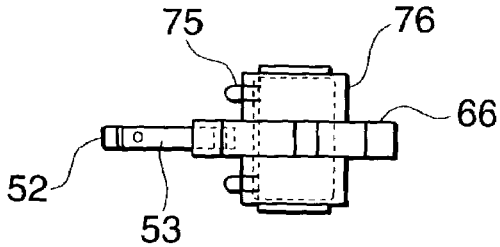
FIG. 4C is a top plan view of a rotary pick and component parts in the vicinity thereof.

FIG. 2 is a top plan view of the performance apparatus according to the present embodiment. FIG. 3 is a sectional view taken along line A—A in FIG. 2. FIG. 4A is a top plan view of an actuator CYL1. FIG. 4B is a view of the actuator as viewed from an arrow F1 in FIG. 4A. Further, FIG. 4C is a top plan view of a rotary pick 66 (sounding element acting member) and component parts in the vicinity thereof.

The present apparatus is constructed as, for example, a music box. It is configured to electrically drivingly control the actuators CYL1 to act on reeds 61 as sounding elements, described hereinafter, so as to individually pluck them to cause them to generate sound (this will hereinafter be referred to as "pluck" or "plucking").

A plurality of (e.g. 20) reeds 61 are each fixed at a base end part 62 thereof to a center block 63, and each reed 61 extends radially outward from the base end 62 on a plane.

A plurality of actuators CYL1 are provided in association with the respective reeds 61. As shown in FIG. 3, each actuator CYL1 is comprised of a solenoid coil 68, a plunger 70, a plunger spring 69 (returning device), a hook part 71, an upper yoke 64, a lower yoke 65, and others. The upper yoke 64 and the lower yoke 65 are shared by all the actuators CYL1 to simplify the construction. Specifically, the upper yoke 64 and the lower yoke 65 are each shaped in the form of a disk, and attached to the center block 63 almost in parallel with each other with a proper distance maintained therebetween by a yoke spacer 67.

The solenoid coil 68 is disposed between the upper yoke 64 and the lower yoke 65. The plunger 70 is disposed inside the solenoid coil 68, for reciprocating motions in the vertical direction. The plunger spring 69 is attached to a lower end of the plunger 70 to permanently apply an upward bias force to the plunger 70. When a driving current is supplied to the solenoid coil 68, a magnetic force is generated to move the plunger 70 downward against the bias force of the plunger spring 69. When the driving current is cut off, the plunger 70 moves upward and returns into an original initial position by the bias force of the plunger spring 69.

On top of the plunger 70, the hook part 71 is mounted so as to define a channel-shaped stepped space 70*a* between the hook part 71 and the plunger 70. A lower end of the hook part 71 facing the channel-shaped stepped space 70*a* serves as an engaging part 71*a*, described hereinafter. A cylinder 77 in which the plunger 70 is slidably fitted has an upper end part and a lower end part in which an upper cushion part 72 and a lower cushion part 73 are respectively provided to absorb shock generated by the vertical motion of the plunger 70 (and the hook part 71).

A rotary pick 66 is provided for each reed 61 and disposed in the vicinity of a radially outer end of the reed 61. The rotary pick 66 has an outer peripheral surface thereof formed integrally with a plurality (four for example) of driving nails, 66*a* (66*a*1 to 66*a*4 in FIG. 5A). Rectangular cam parts 76 are fixedly mounted on opposite end faces of the rotary pick 66, and a cam spring 75 is disposed in closely facing relation to the rotary pick 66 at a side of the rotary pick 66 toward the reed 61. The driving nails 66*a* receive a driving force from the engaging part 71*a* of the channel-shaped stepped space 70*a*, whereby the rotary pick 66 rotates about a rotary shaft 74. As described hereinafter, the cam parts 76 and the cam spring 75 cooperate to rotate the rotary pick 66 substantially only in one direction (clockwise as viewed in FIG. 3).

The cam spring 75 is formed of an elastic sheet material such as a metal sheet and has a U-shaped configuration, as shown in FIG. 4B. The cam spring 75 has one end thereof secured to the body of the apparatus, and has a portion from an intermediate part to the other end which is bifurcated, i.e. has two separated portions, and the two separated portions sandwich the rotary pick 66 therebetween to permanently impart a bias force to the cam part 76 in a direction away from the reed 61. Each cam part 76 has four corners thereof rounded off in a substantially arcuate shape.

Further, each of the drive detectors CS is provided in the vicinity of the rotary pick 66. The drive detector CS is provided for the corresponding reed 61 and disposed below the radially outer end of the reed 61. The configuration of the drive detector CS will be described later.

The plunger 70 and the hook part 71 cooperate to constitute a "reciprocating member". Moreover, the actuator CYL1 and its associated rotary pick 66 cooperate to constitute a "sounding operation device" in which the rotary pick 66 causes the reed 61 to generate sound in unison with a reciprocating motion of the "reciprocating member".

FIG. 5 is a view showing successive changes in motion of essential parts of the actuator CYL1. The actuator CYL1 is drivingly controlled by pulse width modulation (PWM) to cause a reciprocating motion of the plunger 70, as described hereinafter.

Figure 5A:
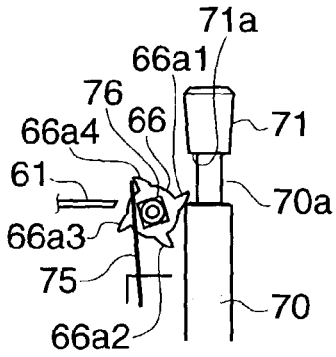
Figure 5B:
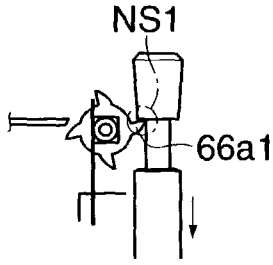
Figure 5C:
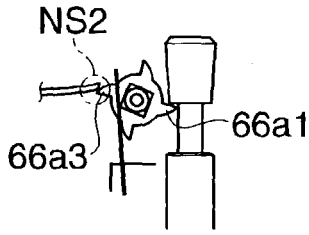
Figure 5D:
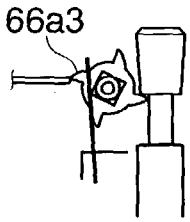

First, as shown in FIG. 5A, in the initial position, the driving nail 66*a*1 of the rotary pick 66 engages in the channel-shaped stepped space 70*a* so that the driving nail 66*a*1 is hooked by the plunger 70. Next, when the solenoid coil 68 is energized, the plunger 70 (and the hook part 71) starts to move downward, then the engaging part 71*a* is brought into contact with the driving nail 66*a*1 (FIG. 5B), the rotary pick 66 rotates clockwise, and the driving nail 66*a*3 located symmetrically to the driving nail 66*a*1 that is engaged with the engaging part 71*a*, plucks the radially outer end of the reed 61, thereby generating sound (FIGS. 5C and 5D). On this occasion, the direction of a rotative driving force applied to the rotary pick 66 due to a reaction force of the cam spring 75 through the cam parts 76 temporarily becomes counterclockwise. However, as a clockwise rotative driving force applied by the engaging part 71*a* surpasses the above counterclockwise rotative driving force, the rotary pick 66 never rotates counterclockwise.

Figure 5E:
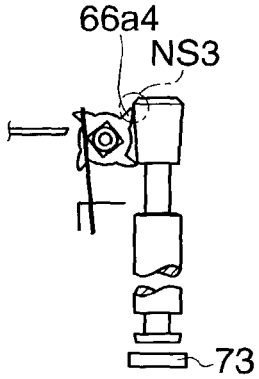
Figure 5F:
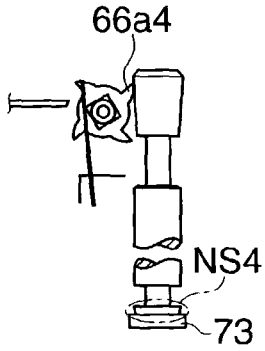

As the plunger 70 further moves downward, the driving nail 66*a*3 which has plucked the reed 61 departs from the reed 61, and thereafter the direction of the rotative driving force applied to the rotary pick 66 due to the reaction force of the cam spring 75 becomes clockwise again. The driving nail 66*a*4 of the rotary pick 66 comes into contact with the hook part 71 to stop the rotation of the rotary pick 66 (FIG. 5E). As the plunger 70 further moves downward, it comes into contact with the lower cushion part 73 and reaches a descending end position as a bottom dead point, namely, a forward stroke end position (FIG. 5F).

Figure 5G:
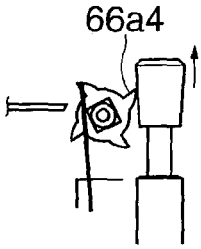

Then, the solenoid coil 68 is deenergized so that the plunger 70 starts to move upward due to a reaction force of the plunger spring 69. However, since the clockwise rotative driving force is still applied to the rotary pick 66 by the cam spring 75, the rotary pick 66 does not rotate counterclockwise even when the plunger 70 moves upward (FIG. 5G).

Figure 5H:
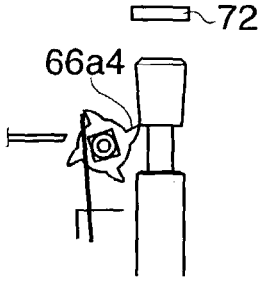
Figure 5I:
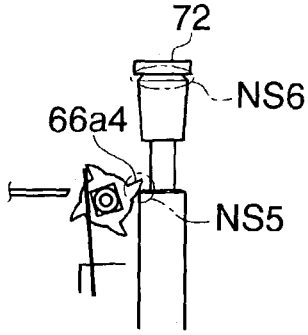

When the plunger 70 further moves upward and returns into a position in the vicinity of the initial position such that the channel-shaped stepped space 70*a* comes to face the driving nail 66*a*4 of the rotary pick 66 (FIG. 5H), the rotary pick 66 rotates clockwise by the clockwise rotative driving force of the cam spring 75 so that the driving nail 66*a*4 slides into the channel-shaped stepped space 70*a* again and engages with the plunger 70. Almost at the same time, the hook part 71 comes into contact with the upper cushion part 72. Thus, the plunger 70 returns into the initial state (FIG. 5I). In the above described way, a sounding operation stroke for generating sound once by plucking the reed 61 is completed.

In the sounding operation stroke, a mechanical noise is generated in specific timing. For example, a mechanical noise is generated mainly by impact when the engaging part 71*a* comes into contact with the driving nail 66*a*1 (a generation point NS1 in FIG. 5B), when the driving nail 66*a*3 comes into contact with the radially outer end of the reed 61 (a generation point NS2 in FIG. 5C), when the driving nail 66*a*4 comes into contact with the hook part 71 (a generation point NS3 in FIG. 5E), when the plunger 70 comes into contact with the lower cushion part 73 (a generation point NS4 in FIG. 5F), when the driving nail 66*a*4 slides into the channel-shaped stepped space 70*a* to engage with the plunger 70 (a generation point NS5 in FIG. 5I), and when the hook part 71 comes into contact with the upper cushion part 72 (a generation point NS6 in FIG. 5I).

Figure 6:
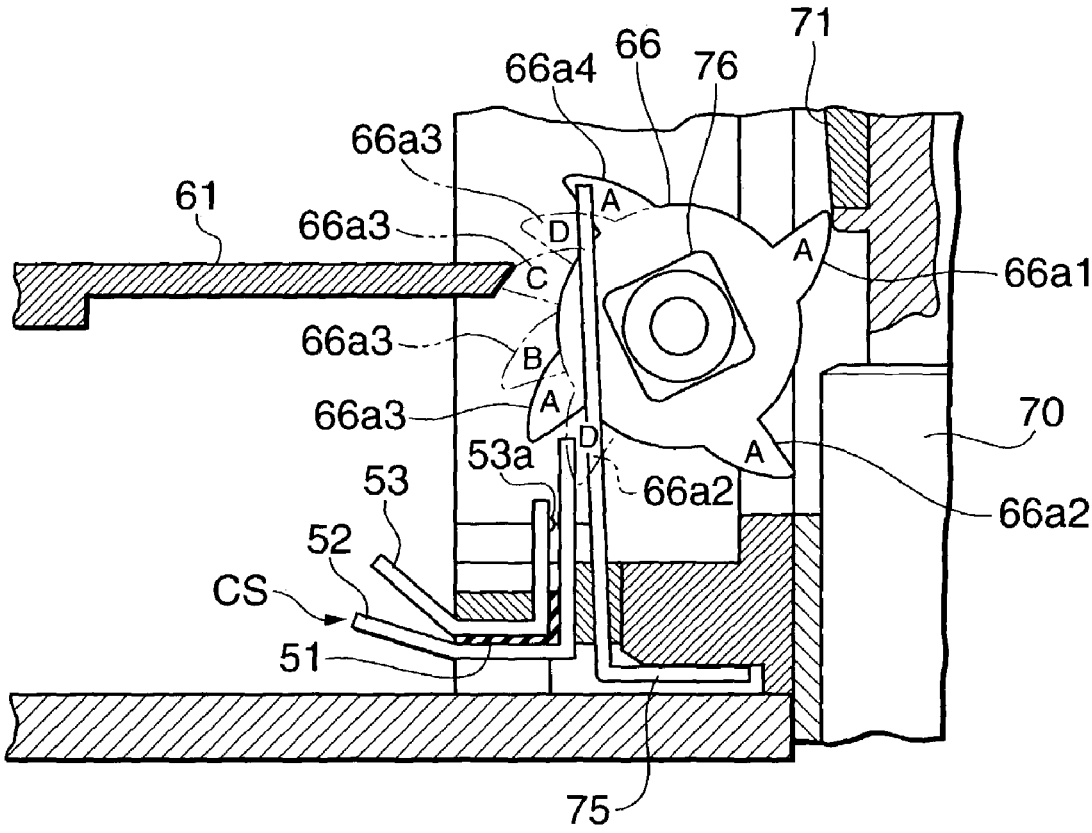
FIG. 6 is an enlarged view of essential parts of the actuator, showing mainly a drive detector and component parts in the vicinity thereof.

FIG. 6 is an enlarged view of essential parts of the actuator, showing mainly a drive detector CS and component parts in the vicinity thereof. In FIG. 6, reference characters "A to D" shown on the driving nails 66*a* denote positions of the driving nails 66*a* during an operation stroke. For example, reference character "A" indicates a position assumed by the driving nail 66*a* when the plunger 70 is moving upward (this position substantially corresponds to FIG. 5G). Reference character "B" indicates a position assumed by the driving nail 66*a* when the rotary pick 66 is waiting to be rotatively driven by the plunger 70 (this position substantially corresponds to FIGS. 5A to 5B). Reference character "C" indicates a position assumed by the driving nail 66*a* when the driving nail 66*a* starts to pluck the reed 61 (this position substantially corresponds to FIG. 5C). Reference character "D" indicates a position assumed by the driving nail 66*a* when the plucking operation is completed (this position substantially corresponds to FIGS. 5D to 5E).

The drive detector CS is comprised of first and second contact leaves 52 and 53 each composed of an elastic conductor with an insulator 51 sandwiched therebetween. The first contact leaf 52 has a half part thereof extending upward to a position where it can come into contact with the driving nail 66*a*. The second contact leaf 53 has an upper part thereof formed with a contact part 53*a* in the form of a projection at a location facing the first contact leaf 52, the contact part 53*a* serving as a contact make point.

When the driving nail 66*a* moves from the position "D" to the position "A" immediately after a plucking operation has been completed, the driving nail 66*a* presses the first contact leaf 52 without fail. Then, an upper part of the first contact leaf 52 is bent toward the second contact leaf 53 to cause the first contact leaf 52 to be come into contact with the contact part 53*a* on the second contact leaf 53 to close the contacts. Thus, completion of plucking of the reed 61 by the driving nail 66*a* is detected. A detection signal indicative of completion of plucking from the drive detector CS is transmitted to the CPU 11.

The above description referring to FIGS. 5 and 6 has been given only of the operation of part of the driving nails 66*a* taking particular rotational positions of the rotary pick 66 by way of example. However, the driving nails 66*a*1 to 66*a*4 sequentially perform similar operations.

Now, a description will be given of driving control of the actuator CYL1 based on pulse width modulation (PWM).

Figure 7A:
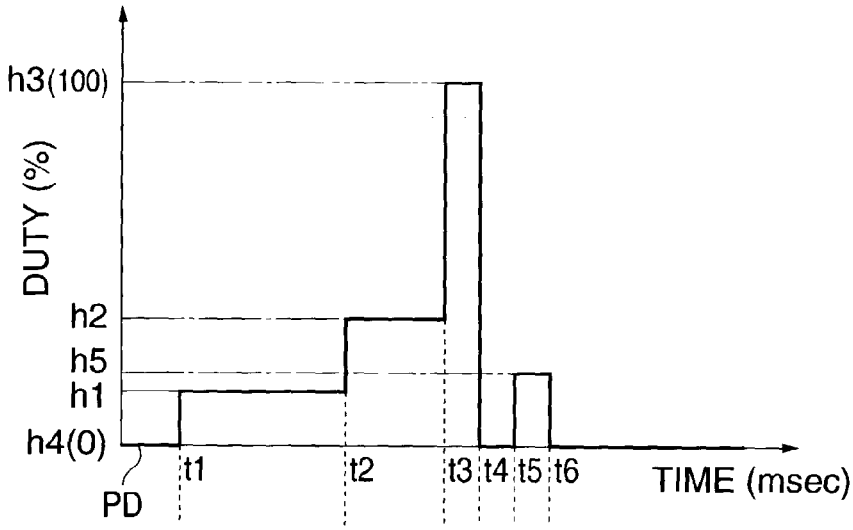
Figure 7B:
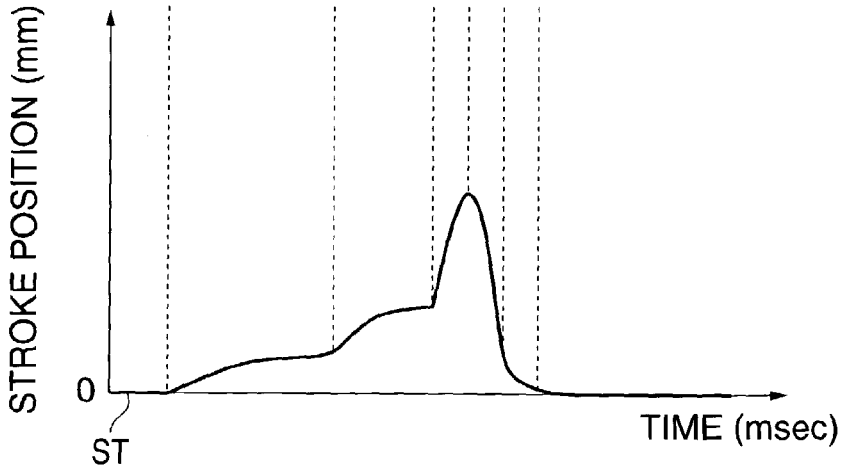

FIGS. 7A and 7B collectively form a timing chart, in which FIG. 7A shows a PWM control waveform, and FIG. 7B shows a stroke position of the plunger 70. In FIG. 7A showing a PWM control waveform PD, the ordinate indicates the duty (%) of a driving pulse and the abscissa indicates time (msec). In FIG. 7B showing a stroke position waveform ST for the plunger 70, the ordinate indicates the distance (mm) by which the plunger 70 (and the hook part 71) has moved downward with the initial position of the plunger 70 being defined as "0", the distance being shown in association with the PWM control waveform PD. Each time point t corresponds to the time elapsed from a reference point of time, i.e. a time point when key-on event data contained in performance data is received, for example.

The PWM control waveform PD corresponds to changes in driving energy supplied to the actuator CYL1 with time. It is defined by a PWM table (predetermined table), not shown. In the PWM table, the duty is associated with time sections (for example, t2–t1) corresponding respectively to a plurality of steps into which the operation stroke is divided, the duty and the steps being parameters. This PWM table is stored in, for example, the memory 13 so as to be updated as required. For example, the initial setting of the PWM table is such that the duty is set to a plurality of values corresponding to the respective steps, for example, h1 (e.g. 10%) for a step between time points t1 and t2, h2 (e.g. 30%) for a step between time points t2 and t3, h3 (e.g. 100%) for a step between time points t3 and t4, h4 (e.g. 0%) for a step between time points t4 and t5, and h5 (e.g. 15%) for a step between time points t5 and t6.

The time sections in FIGS. 7A and 7B are associated with the successive changes in motion described with reference to FIG. 5 in a manner as described below. In the initial state (FIG. 5A), at the time point t1, a driving pulse rises based on performance data. Then, the plunger 70 operates as shown in FIGS. 5A to 5B between the time points t1 and t2, as shown in FIGS. 5B to 5C between the time points t2 and t3, as shown in FIGS. 5C to 5F between the time points t3 and t4, as shown in FIGS. 5G to 5H between the time points t4 and t5, and as shown in FIGS. 5H to 5I between the time points t5 and t6.

Here, the reason why the duty assumes the maximum value between the time points t3 and t4 is that the maximum power is required during this time period to actually pluck the reed 61. On the other hand, in the other time sections, the duty is reduced to lower the power consumption. For example, between the time points t1 and t2, the plunger 70 only runs idle. Between the time points t2 and t3, the rotary pick 66 also runs idle. Further, at and after the time point t4, substantially no driving force is required. Therefore, only a low duty is required in these time sections.

Such stepwise duty control contributes not only to saving power but also to preventing mechanical noise. For example, between the time points t1 and t2, the duty is lower (h1). Thus, the velocity at which the plunger 70 runs idle is lower than that assumed if a high duty (for example, 100%) is uniformly applied for driving in all the time sections. This weakens a shock or impact that may occur when the engaging part 71*a* and the driving nail 66*a* of the rotary pick 66 come into contact with each other as shown in FIG. 5B. Consequently, mechanical noise is reduced at the generation point NS1.

Further, at and after the time point t4, the plunger 70 is moved upward by the plunger spring 69. Therefore, it is assured that the plunger 70 returns even with the duty maintained at "0". However, the plunger 70 returns quickly due to the bias force of the plunger spring 69, thus causing a loud impact noise to be generated when the hook part 71 comes into contact with the upper cushion part 72. Therefore, between the time points t5 and t6, the duty is once increased (h5). This serves to brake the returning motion of the plunger 70 immediately before the hook part 71 and the upper cushion part 72 come into contact with each other to weaken an impact that may occur upon the contact. Consequently, mechanical noise is reduced at the generation point NS6, shown in FIG. 5I.

Furthermore, in the present embodiment, the PWM table is updated based on the result of the detection by the drive detector CS. For example, it is assumed that the drive detector CS detects a time point T of completion of plucking of the reed 61. The difference ΔT between the time points T and t3 is determined from an equation ΔT=T−t3. Then, the PWM table is rewritten based on the difference ΔT. The CPU 11 carries out PWM control with reference to the updated PWM table. The PWM table is updated, for example, as follows:

The difference ΔT is compared with predetermined values K1 (for example, 0.2 msec) and K2 (for example, 0.5 msec). Then, if ΔT<K1, it is determined that the plucking operation is "normal". If K1≦Δ≦K2, it is determined that the plucking operation is "improper" and close to a "mistake". If K2<ΔT, it is determined that the plucking operation is a "mistake". In the case of the "mistake", a warning sound or the like may be issued to notify the user of it. If the plucking operation is "improper", either of the parameters is changed according to "Changes (i) to (iv)" given below.

"Change (i)": the time section between the time points t3 and t4 is slid backward (in the direction in which this time section is delayed).

"Change (ii)": the time point t3 is shifted forward (advanced), the time point t4 is shifted backward, or both operations are carried out to enlarge the time section between the time points t3 and t4.

"Change (iii)": if the duty for the time section between the time points t3 and t4 is not 100%, it is increased.

"Change (iv)": the duty for the time section between the time points t2 and t3 is increased.

Here, for "Changes (i) and (ii)", the amount by which the time section or the time is shifted for a single correction is set to a predetermined time period. Alternatively, a single correction may be carried out based on the difference ΔT so that the difference ΔT becomes "0". Further, for "Changes (iii) and (iv)", the amount by which the duty is increased for a single correction is set to a predetermined amount. For example, in "Change (iii)", the duty is increased by (t4−t3)×h3×0.1 msec.

"Changes (i) to (iv)" basically correct the parameters so as to increase the driving energy supplied during and/or before plucking. However, the manner of correcting the parameters is not limited to "Changes (i) to (iv)" given above and may be other manners insofar as substantially the same effects are obtained.

The PWM table is updated for each plucking operation or for each piece of music. Alternatively, the PWM table may be updated in arbitrary timing desired by the user so that even if the plucking timing becomes shifted due to wear of the reed 61, rotary pick 66, hook part 71, or plunger 70, the optimum plucking operation can be easily recovered. Further, the PWM table may be provided for each actuator CYL1. Then, more appropriate driving control can be achieved in association with the status of each actuator CYL1 such as wear of the same.

According to the present embodiment, the duty is set to the maximum value between the time points t3 and t4 at which the maximum power is required, and is reduced during the other time sections. As a result, wasteful power consumption can be suppressed to reduce energy consumption while allowing the reed 61 to be properly plucked.

Further, the duty is set to be lower during the time period between the time points t1 and t2, which is just before the plunger 70 and the driving nail 66*a* of the rotary pick 66 come into contact with each other. This weakens an impact that may occur when the engaging part 71*a* and the driving nail 66*a* come into contact with each other. As a result, mechanical noise can be reduced.

Furthermore, the duty is increased during the time period between the time points t5 and t6, which corresponds to the latter half of the return stroke of the plunger 70. As a result, the return speed of the plunger 70 becomes lower. This weakens an impact that may occur when the upper cushion part 72 and the hook part 71 come into contact with each other. As a result, mechanical noise can be reduced.

Moreover, the PWM table is updated based on the detected plucking completion time point T. Therefore, an appropriate plucking state can be maintained for a long time.

In this regard, mechanical noise cannot be easily suppressed at the generation points NS2, NS3, NS4, and NS5 by the above control of changing the duty alone. Therefore, for the generation point NS2, a damper may be provided for the reed 61 to suppress a contact noise that may be generated upon re-contact of the driving nail 66*a* with the reed 61 particularly during a continuous plucking operation. For the generation points NS3 and NS5, shock noise is weakened by forming those portions of the hook part 71 and the plunger 70 which come into contact with the driving nail 66*a*, from a soundproof material.

In particular, for the generation point NS3, when the driving nail 66*a* comes into contact with the hook part 71, i.e. when the position of a driving nail 66*a* shifts from "D" to "A" in FIG. 6, the driving nail 66*a* presses the first contact leaf 52 to subject the rotary pick 66 to a reaction force generated by the first contact leaf 52, that acts in the reverse rotational direction. Thus, immediately before the driving nail 66*a* at the symmetrically opposite location comes into contact with the hook part 71, the rotation speed of the rotary pick 66 decreases. This also weakens an impact that may occur upon the driving nail 66*a* contacting the hook part 71, thus reducing mechanical noise. Therefore, the drive detector CS does not have only the function of detecting the plucking completion time point T but also the function of reducing mechanical noise at the generation point NS3.

Further, for the generation point NS4, by advancing the time point t4 so as to avoid a plucking mistake, the velocity of the plunger 70 decreases immediately before the plunger 70 comes into contact with the lower cushion part 73. This weakens an impact noise that may occur upon the plunger 70 contacting the lower cushion part 73.

In the present embodiment, the reed 61 is plucked by the plunger 70 (and the hook part 71) through the rotary pick 66 as a sounding element acting member. However, to suppress a possible mechanical noise at the generation point NS6 by increasing the duty between the time points t5 and t6, it is possible to use an arrangement other than the arrangement in which the reed is plucked through the sounding element acting member. The mechanical-noise suppression effect based on an increase in duty between the time points t5 and t6 can be obtained by using, for example, an arrangement in which a plucking part secured to the plunger 70 directly plucks the reed 61.

Now, a second embodiment of the present invention will be described with reference to FIGS. 1, 5, and 7 to 9.

Figure 8:
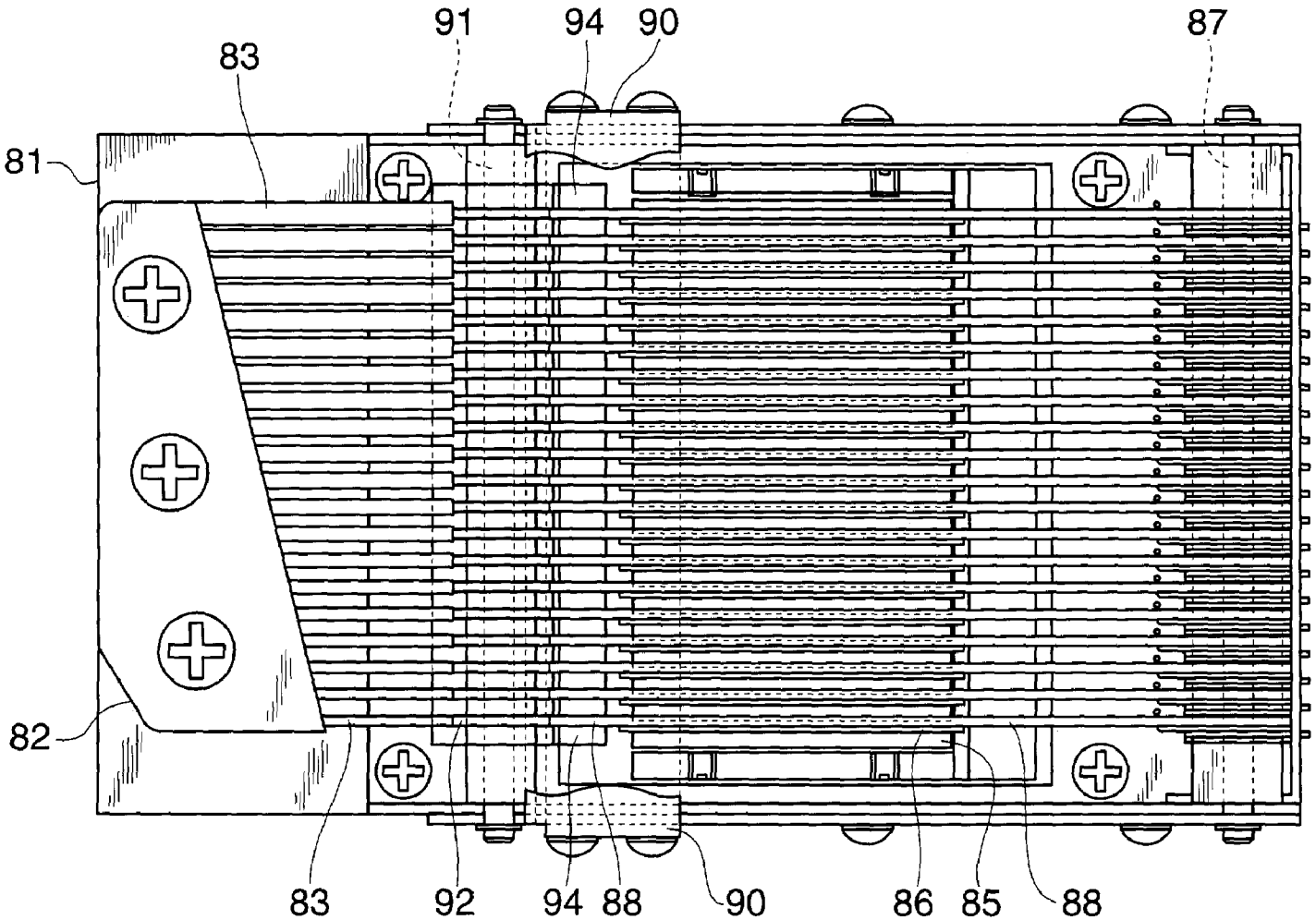
FIG. 8 is a top plan view showing a performance apparatus according to a second embodiment of the present invention.
Figure 9A:
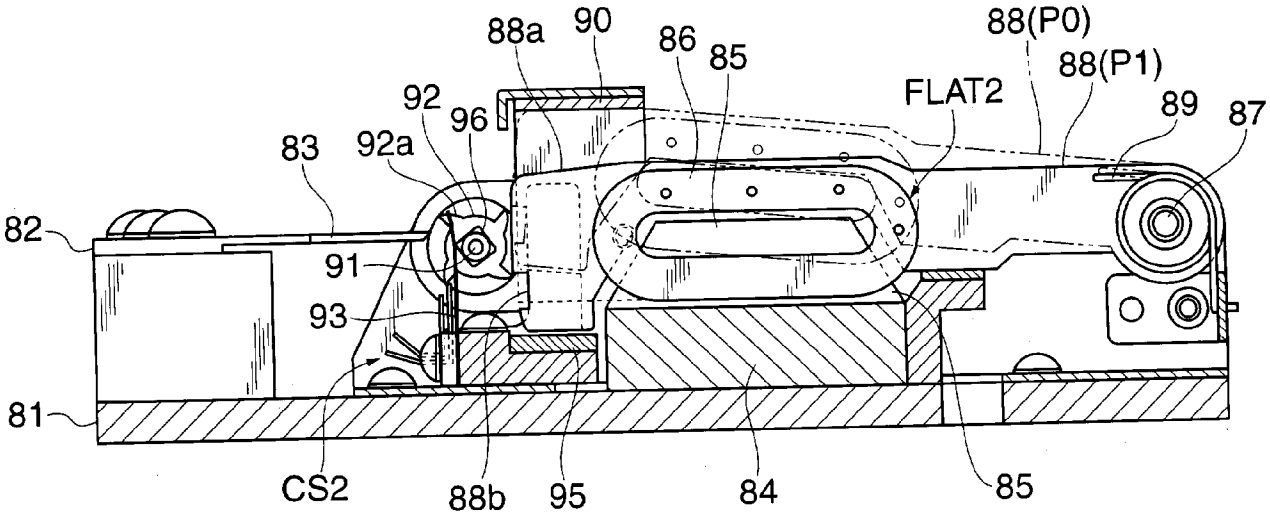
FIG. 9A is a sectional view of the performance apparatus in FIG. 8.
Figure 9C:
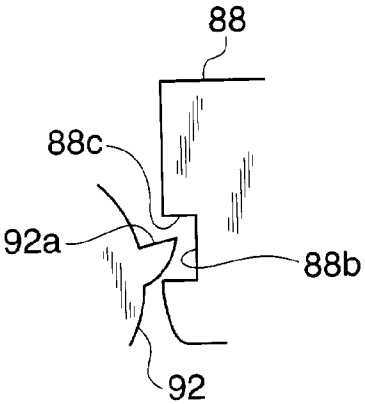
FIG. 9C is an enlarged fragmentary view of a channel-shaped stepped space and a driving nail of a rotary pick of the performance apparatus.
Figure 9B:
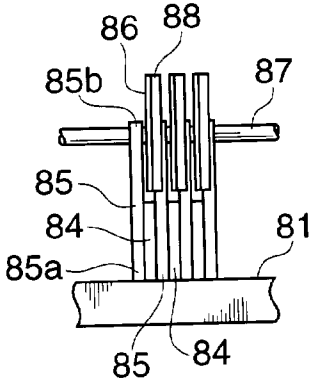
FIG. 9B is a front view showing essential parts of the performance apparatus as viewed from a left side in FIG. 9A.

FIG. 8 is a top plan view of a performance apparatus according to the second embodiment of the present invention. FIG. 9A is a sectional view of this apparatus. FIG. 9B is a front view showing essential parts of the apparatus as viewed from a left side in FIG. 9A. FIG. 9C is an enlarged fragmentary view of a channel-shaped stepped space and a driving nail of a rotary pick.

In the second embodiment, the construction of the control section is basically the same as that shown in FIG. 1 in the first embodiment. However, an actuator FLAT2, which is implemented by a flat coil type, is employed in place of the actuator CYL1. Further, a drive detector CS2 is employed in place of the drive detector CS. The actuator FLAT2 is drivingly controlled by pulse width modulation (PWM) as is the case with the first embodiment (see FIG. 7). The PWM table is also updated as is the case with the first embodiment.

As shown in FIG. 8, a plurality of reeds 83, which are a plurality of sounding elements of different sounding pitches, extend in the form of comb teeth from a base end member 82 fixed to a base plate 81. Further, rotary picks 92 are disposed in association with the respective reeds 83 in proximity to the tips of the reeds 83.

The actuator FLAT2 is comprised of magnets 84, yokes 85, swing arms 88, flat coils 86, and so on, as shown in FIG. 9A. Each of the magnets 84, which is made of a rare earth magnet such as a neodymium-based magnet, and an associated one of the yokes 85 cooperate to constitute a magnetic field generator which serves to generate a force for driving an associated one of the swing arms 88.

Specifically, the magnets 84 are fixed to the base plate 81 and arranged thereon in association with the respective reeds 83 in a direction in which the reeds 83 are juxtaposed. Each yoke 85 is disposed between adjacent magnets 84 such that the magnets 84 and the yokes 85 are alternately arranged. Each yoke 85 has a lower end 85*a* thereof sandwiched between adjacent ones of the magnets 84 and has an upper end 85*b* thereof projecting upward, whereby a magnetic field is formed above the magnets 84 and between the upper ends 85*b* of adjacent yokes 85.

As shown in FIG. 9A, each swing arm 88 has a free end 88*a* thereof disposed to vertically swing about a swing shaft 87. Arranged in proximity to the swing shaft 87 of the swing arm 88 is a swing arm spring 89 which permanently urges the swing arm 88 clockwise as viewed in FIG. 9A. FIG. 9A shows a state in which the swing arm 88 (swing arm 88 (P1)) is being swung. In the initial state, the swing arm 88 is biased by the spring 89 such that the swing arm 88 is in contact with an upper limit stopper 90 (a position indicated by the swing arm 88 (P0)). A lower limit stopper 95 determines a position in which the swing arm 88 stops to be swung. A lateral guide 94 is disposed between adjacent swing arms 88 (FIG. 8), which restricts the movement of the swing arms 88 in a lateral direction (the direction in which the reeds 83 are juxtaposed).

Each flat coil 86 is shaped in the form of a plate and mounted on a corresponding swing arm 88. The flat coil 86 is disposed almost parallel with the vertical direction as well as with the longitudinal direction of the reed 83. The flat coil 86 is located in the magnetic field formed between the upper ends 85*b* of the yokes 85, and when the flat coil 86 is energized, the corresponding swing arm 88 is swung downward according to Fleming's left-hand rule. When the flat coil 86 is deenergized, the corresponding flat arm 88 is urged by the spring 89 to return into the original initial position.

As is the case with the first embodiment, each rotary pick 92 has its peripheral surface formed integrally with a plurality of, e.g. four, driving nails 92*a*, a rectangular cam part 96 is fixedly mounted on opposite end faces of the rotary pick 92, and a cam spring 93 is disposed in closely facing relation to the rotary pick 92. The swing arm 88 has a free end 88*a* formed integrally with a channel-shaped stepped space 88*b* which is similar to the channel-shaped stepped space 70*a* in the first embodiment. As shown in FIG. 9C, the channel-shaped stepped space 88*b* has the same function as the channel-shaped stepped space 70*a* in the first embodiment, and has an engaging part 88*c* that corresponds to the engaging part 71*a* of the hook part 71.

As is the case with the first embodiment, the driving nails 92*a* receive a driving force from the engaging part 88*c* of the channel-shaped stepped space 88*b*, whereby the rotary pick 92 rotates about a rotary shaft 91. The cam part 96 and the cam spring 93 serve to cause the rotary pick 92 to rotate substantially only in one direction (clockwise as viewed in FIG. 9A).

With the above described construction, in place of the reciprocating motion of the plungers 70 in the first embodiment, the swing arms 88 swing in the vertical direction. In the present embodiment, the relationship in operation between the channel-shaped stepped space 88*b* and the rotary pick 92 is the same as the relationship between the channel-shaped stepped space 70*a* and the rotary pick 66 in the first embodiment, and the two parts 88 and 92 make successive changes in motion in the same manner as shown in FIG. 5.

Further, as shown in FIG. 9A, the drive detector CS2 is provided in proximity to the rotary pick 96. The drive detector CS2 is disposed below the tip of each reed 83 in association with the reed 83. The construction and operation of the drive detector CS2 are the same as those of the drive detector CS in the first embodiment.

According to the present embodiment, substantially the same effects as those of the first embodiment can be obtained. That is, energy consumption can be reduced while allowing the sounding elements to properly generate sound. Further, an appropriate plucking state can be maintained for a long time by updating the PWM table. In addition to these effects, the second embodiment provides the effects described below. Stepwise control is provided based on pulse width modulation to weaken an impact that may occur when the driving nail 92*a* of the rotary pick 92 and the engaging part 88*c* of the channel-shaped stepped space 88*b* engage with each other. The duty is increased in the latter half of the return stroke of the swing arm 88 to reduce the returning velocity of the swing arm 88, thus weakening an impact that may occur when the swing arm 88 and the upper limit stopper 90 come into contact with each other. Therefore, the second embodiment provides substantially the same effects as those of the first embodiment in connection with a reduction in mechanical noise that may occur upon contacting or engagement at the generation point NS1 or NS6, respectively.

In the above described first and second embodiments, the reeds are illustrated as sounding elements. However, the present invention is not limited to this. The present invention is applicable to any other sounding elements that produce acoustic sound when acted upon by either physical or magnetic means, e.g. sounding elements such as "strings" or "sound boards" which generate sound when mechanically excited. These sounding elements include, for example, plate-like sounding elements made of metal, wood, or the like. Further, in the above embodiments, pulse width modulation is used to supply driving energy to the actuators CYL1 and FLAT2 and to control these actuators. However, the present invention is not limited to this. It is possible to employ any other means capable of effecting changes in the driving energy with time.

What is claimed is:

1. A performance apparatus comprising:

a plurality of reeds acting as sounding elements;

at least one sounding element actor that plucks said reeds to cause said reeds to generate sound;

at least one actuator that drives said sounding element actor; and a driving control device that drivingly controls said actuator by supplying a driving energy to said actuator;

wherein said driving control device supplies a predetermined driving energy to said actuator to start driving said sounding element actor, and wherein said driving control device supplies a driving energy higher than the predetermined driving energy to said actuator when said sounding element actor plucks a reed after said actuator starts driving said sounding element actor.

2. The performance apparatus according to claim 1, further comprising an action state detecting device that detects a state of action that is exerted by said sounding element actor upon said reed, wherein said driving control device is operable based on the state of action detected by said action state detecting device, for drivingly controlling said actuator such that the driving energy supplied to said actuator is changed in at least one of timing in which said sounding element actor plucks a reed and timing immediately before said sounding element actor plucks a reed.

3. The performance apparatus according to claim 1, further comprising an action state detecting device that detects a state of action that is exerted by said sounding element actor upon said reed, wherein said driving control device is operable based on the state of action detected by said action state detecting device, for drivingly controlling said actuator so as to correct timing in which the driving energy is supplied to said actuator and which corresponds to the timing in which said sounding element actor plucks a reed.

4. The performance apparatus according to claim 1, wherein said driving control device drivingly controls said actuator by changing the driving energy using pulse modulation.

5. The performance apparatus according to claim 1, further comprising a storage device that stores a predetermined table for determining magnitude of the driving energy, wherein said driving control device drivingly controls said actuator by referring to the predetermined table stored in said storage device.

6. The performance apparatus according to claim 5, further comprising:

an action state detecting device that detects a state of action that is exerted by said sounding element actor upon said reed, and an updating device that updates contents of the predetermined table stored in said storage device based on the state of action detected by said action state detecting device.

7. A performance apparatus comprising:

a plurality of reeds acting as sounding elements;

at least one sounding element actor that plucks said reeds to cause said reeds to generate sound;

at least one actuator that is engageable with said sounding element actor, for driving said sounding element actor; and a driving control device that drivingly controls said actuator by supplying driving energy to said actuator;

wherein said driving control device drivingly controls said actuator such that a lower driving energy is supplied to said actuator immediately before said actuator engages with said sounding element actor to start driving said sounding element actor, and wherein the lower driving energy is less than a driving energy used when said sounding element actor plucks a reed.

8. The performance apparatus according to claim 7, wherein said driving control device drivingly controls said actuator by changing the driving energy using pulse modulation.

9. The performance apparatus according to claim 7, further comprising a storage device that stores a predetermined table for determining magnitude of the driving energy, and wherein said driving control device drivingly controls said actuator by referring to the predetermined table stored in said storage device.

10. The performance apparatus according to claim 9, further comprising;

an action state detecting device that detects a state of action that is exerted by said sounding element actor upon said reeds, and an updating device that updates contents of the predetermined table stored in said storage device based on the state of action detected by said action state detecting device.

11. A performance apparatus comprising:

a plurality of reeds acting as sounding elements;

at least one sounding operating device having at least one sounding element actor and at least one reciprocating member, wherein said sounding element actor plucks a reed in unison with a reciprocating motion of said reciprocating member to cause said reed to generate sound;

a driving control device that drivingly controls said reciprocating member in a forward direction by supplying a driving energy to said sounding operating device;

a returning device that urges said reciprocating member in a backward direction, for returning said reciprocating member into an original position thereof; and a stopper that is disposed for contact with said reciprocating member, for defining a backward stroke end position of said reciprocating member;

wherein said driving control device drivingly controls said reciprocating member such that a lower driving energy for urging said reciprocating member in the forward direction is supplied to said sounding operating device immediately before said reciprocating member and said stopper come in contact with each other, to suppress said reciprocating member from returning into the original position thereof, and wherein said lower driving energy is less than a driving energy used when said sounding element actor plucks a reed.

* * * * *